United States Patent [19]

Boller et al.

[11] Patent Number: 4,553,906

[45] Date of Patent: Nov. 19, 1985

[54] POSITIVE DISPLACEMENT ROTARY COMPRESSORS

[75] Inventors: Edward Boller, Halesowen; Michael R. Williams, Solihull, both of

[73] Assignee: Hydrovane Compressor Company Limited, Redditch, England

[21] Appl. No.: 654,678

[22] Filed: Sep. 26, 1984

[30] Foreign Application Priority Data

Sep. 28, 1983 [GB] United Kingdom ..... 8326017

[51] Int. Cl.[4] ..... F04B 49/02; F04B 49/08; F04B 49/10

[52] U.S. Cl. ..... 417/295; 417/310; 418/97; 418/DIG. 1

[58] Field of Search ..... 417/295, 310; 418/97, 418/98, 99, DIG. 1

[56] References Cited

U.S. PATENT DOCUMENTS

| | | | |
|---|---|---|---|
| 3,395,856 | 8/1968 | Clark | 417/295 X |
| 3,448,916 | 6/1969 | Fraser | 417/295 X |
| 4,068,980 | 1/1978 | Fine et al. | 417/295 X |
| 4,388,046 | 6/1983 | Boller | 417/295 |

*Primary Examiner*—Richard E. Gluck
*Attorney, Agent, or Firm*—Cushman, Darby & Cushman

[57] ABSTRACT

A positive displacement rotary compressor includes a stator which contains a rotor and has a stator inlet communicating with atmosphere via a first pilot operated valve and a stator outlet connected to a primary lubricant reservoir via a non-return valve and to an auxiliary lubricant reservoir via a second pilot operated valve and one or more lubricant injection orifices arranged to inject oil into the stator and connected to the primary reservoir via a third pilot operated valve and to the secondary reservoir. The compressor also includes a pilot control system responsive, in use, to the compressed air load to which the compressor is subjected and arranged to switch the first and third pilot operated valves from an open position to a closed position and the second pilot operated valve from a closed position to an open position when the compressed air load falls below a predetermined value. The auxiliary lubricant reservoir is always at substantially atmospheric pressure.

10 Claims, 3 Drawing Figures

POSITIVE DISPLACEMENT ROTARY COMPRESSORS

The present invention relates to positive displacement rotary compressors of oil-sealed type, particularly such compressors of eccentric rotor sliding vane type, and is concerned with reducing the power consumed by such compressors when operating under no-load or reduced load conditions. The term "oil-sealed compressor" is used herein to designate that type of compressor in which a lubricant is injected into the compression space and is then subsequently removed from the compressed air and recycled.

When a positive displacement rotary compressor is operating at less than full load conditions, the pressure at its outlet tends to rise to a value above the normal working value and/or the pressure at its inlet tends to fall to a value less than normal. This means that the compression elements must work against a pressure differential higher than normal with the result that such compressors tend to consume more power per volumetric unit of output at, say, three quarters load than they do at full load. When the compressed air requirement is less than the full load requirement the outlet pressure tends in fact to continue rising and for this reason it is known to provide the inlet of such compressors with a pilot operated valve which closes the inlet when the outlet pressure reaches a predetermined value. Such valves may be movable between only two positions, that is to say a fully opened position and a fully closed position, or alternatively the valve may be progressively controlled by a servo valve in response to a rise of the outlet pressure above the normal working pressure to modulate the inflowing air with the result that as the outlet pressure rises, the inlet is progressively throttled and then finally closed. The provision of such a valve on the compressor inlet results in a power economy at no-load or reduced load conditions but the compressor still consumes a very substantial amount of power since the internal pressure differential across the compression elements is still above the normal value.

Accordingly, to effect a substantial economy in the power consumed by such compressors when operating at no-load conditions, it is necessary to reduce the pressure within the compression space and clearly the minimum amount of power will be consumed when this pressure is zero. There is however normally a constraint on the reduction in the compressor pressure since the oil which is injected into the compression space is normally injected by the pressure differentials existing within the compressor. If the compressor were vented down to atmospheric pressure, no such pressure differentials would exist in the conventional compressor construction and thus no oil would be injected under no-load conditions. In compressors of both eccentric rotor sliding vane type, and also of screw type, substantial volumes of oil are injected into the compression space firstly to cool the compressed air, secondly to ensure a reliable seal of the compression elements with the stator, and thirdly to lubricate the compression elements. When a compressor is operating at no load with its inlet valve fully closed, no air is being compressed, and thus no oil is required for the first function referred to above. However, oil is still required for the third function to avoid the compressor suffering excessive mechanical wear and thus it has been conventionally believed that it is not practicable to reduce the pressure within the compressor to atmospheric pressure when the compressor is operating at no-load.

British Patent Specification No. 1599319 of the present Applicants, discloses an eccentric rotor sliding vane compressor of generally conventional construction in which oil is injected into the compression space, and subsequently removed by one or more oil separation stages, and returned to a sump within the compressor casing for reuse, whilst the compressed air is delivered to a supply line which includes a no-return valve. Downstream of the non-return valve is a pressure sensitive switch which is coupled to a vent in the compressor casing, and arranged to open this vent when the compressor delivery pressure rises above a predetermined value, thus indicating that there is substantially no compressed air demand, to vent the pressure within the stator and the compressor casing down to a reduced value. The vent valve and the servo controlled unloader valve in the compressor inlet are, however, so constructed that the compressor pressure does not drop below a value of about 2 bar since this is believed to be the minimum pressure at which an amount of oil will be passed from the sump into the compression space which is sufficient for the purpose for which it is required. Thus, whilst this construction consumes a substantially reduced amount of power under no-load conditions as compared to a compressor whose internal pressure differential is above the normal value under no-load conditions the compressor still consumes about 30% of its full rated power since there is a back pressure of about 2 bar acting on the compression elements and in addition a certain amount of work must be performed to inject the oil. If this known compressor is operating at, say 5% of full load, the unloader valve will be moved substantially to its closed position but the compressor pressure will still gradually rise to a value above the predetermined value, at which point the interior of the compressor will be vented down to its idling value. However, the pressure in the supply line will then fall as a result of the continued air consumption to a value at which the compressor is returned to normal operation. Thus, under these conditions the compressor is continuously cycled between its full load and idling modes which in itself represents a substantial waste of power since the compressor is continually compressing air which is subsequently exhausted to atmosphere through the vent valve.

The desired reduction in power consumption is achieved by virtue of the reduction of the pressure at the stator outlet. However, in the construction disclosed in the prior patent referred to above, the rotor/-stator unit is situated within an outer casing, accommodating a primary oil separation stage and the oil sump, and it is the entire compressor casing that is vented to atmosphere. Thus, a very much larger volume is vented down to the reduced pressure than is actually necessary for the purpose of achieving the desired power economy under no-load conditions, and this results in the power economy being very much less than that which is theoretically possible.

Many of the disadvantages referred to above are avoided in the construction disclosed in British Patent No. 1257728. This prior patent discloses a compressor of eccentric rotor sliding vane type whose inlet includes a pilot operated shut-off valve, and which is not contained in an outer casing defining a lubricant sump but which has an outlet communicating with a separate main lubricant reservoir via a non-return valve and with an auxiliary lubricant reservoir. The main lubricant reservoir communicates with an oil injection aperture in the stator by means of a pipe including a pilot operated valve whilst the auxiliary reservoir communicates directly with this aperture. The pipe connecting the compressor outlet to the lubricant reservoirs may be selectively vented to the atmosphere by a further pilot controlled valve. The various pilot controlled valves are under the control of a pilot which is responsive to the pressure in the main lubricant reservoir. In normal operation, air is drawn in through the inlet and compressed by the rotor/stator unit into which lubricant is injected from the main reservoir under the action of the pressure differential between the main reservoir and the compression space. The compressed air and oil mixture pass out of the outlet in the stator and a proportion of the oil is deposited in the auxiliary reservoir thereby maintaining the latter substantially full of lubricant. The remainder of this mixture passes to the main reservoir where the remaining oil is deposited and the air passes to an outlet line. If the compressed air load is reduced substantially below the full rate load, the pressure in the main reservoir rises and when this exceeds the predetermined pressure the pilot closes the pilot operated valve in the inlet thereby preventing further air from entering the compressor inlet, closes the pilot operated valve in the line connecting the main reservoir to the rotor/stator unit, thereby preventing oil from being fed from this reservoir into the compression space, and opens the pilot operated valve communicating with the pipe connecting the stator outlet to the main reservoir thereby connecting the stator outlet to atmosphere. The non-return valve in the pipe connecting the stator outlet to the main reservoir closes, and the main reservoir therefore remains substantially at the nominal compressor pressure. However, the compression space and the auxiliary lubricant reservoir are substantially at atmospheric pressure whilst the pressure at the inlet tends to drop to a value somewhat below atmospheric pressure. The pressure in the compression space at the oil injection aperture is therefore also slightly subatmospheric and this pressure therefore results in a small volume of oil being drawn from the auxiliary reservoir into the compression space and this volume is sufficient for the needs of the rotor/stator unit. The oil that is so injected is returned to the auxiliary reservoir, and is then available for reuse. If the compressed air load should resume, or alternatively if the compressed air load had not in any event fallen to zero, the pressure in the main reservoir progressively falls and when this becomes less than a further predetermined value, the pilot reverses the positions of the various pilot operated valves and normal operation is resumed.

This construction has a number of advantages in that when the compressor is running under no-load conditions, the pressure at the stator outlet is atmospheric and thus the rotor/stator unit absorbs the minimun amount of power, perhaps about 20% of its full rated power. If the compressed air demand is a fraction of the full rated output, the compressor will cycle between normal operation and its idling depressurised operation, but this will waste a relatively small amount of power since only the interior of the stator and the auxiliary reservoir are vented to atmosphere, and thus must be subsequently repressurised, and the main reservoir, which corresponds to the sump within the compressor casing in a conventional compressor, is retained at all times at substantially the nominal working pressure of the compressor.

However, it is believed that a compressor in accordance with British Patent No. 1257728 has never been constructed, and further that such a construction suffers from a number of disadvantages. The first of these is that when the compressor is switched from normal operation to idling operation, a proportion of the oil in the pipe between the stator and the main reservoir is lost to atmosphere. This loss can be minimised by connecting the vent line to the compressor inlet, but nevertheless a certain amount of oil is lost which is of long term significance if the compressor is running, at, say, 90% of its full rated output since it will be constantly cycling between normal and idling operation and in addition under these conditions lubricant that is withdrawn from the auxiliary reservoir may be returned to the main reservoir without there being time for the auxiliary reservoir to be refilled with the result that in time the auxiliary reservoir may have no lubricant left in it, and will thus be unable to fulfill its intended function. Of more importance, however, is the fact that the full energy saving potential of this construction can only be realised if the rotor/stator unit and auxiliary reservoir can be vented down to atmospheric pressure very rapidly since if this were to occur only slowly, little or no advantage may be realised if the compressor is cycling at a rapid rate between its normal and idling modes. Typically, when leaving the stator of a compressor of this type, the lubricant is at a pressure of about 7 bar and contains a substantial volume of air either in dissolved form, or in the form of small bubbles. If the lubricant is depressurised very rapidly, the presence of the air results in a foaming of the lubricant which not only presents problems in the lubrication of the rotor/stator unit since foaming lubricant will not pass readily down a lubricant passage, but also results in a progressive loss of the lubricant from the compressor since lubricant foam is readily entrained in compressed air and is not readily removed therefrom by conventional separating means. For these reasons it is necessary in the construction of British Patent No. 1257728 to ensure that the rate of depressurisation of the stator and auxiliary reservoir is relatively low, and as a result the full advantage which might be expected from this construction can in practice not be achieved.

Accordingly it is an object of the present invention to provide a positive displacement rotary compressor of oil sealed type which has all the advantages of the construction of British Patent No. 1257728 but which avoids its disadvantages and which in particular does not suffer from the problem of gradual lubricant loss and which can be depressurised extremely rapidly when entering no-load conditions without any substantial problems arising as a reslt of the lubricant foaming.

According to the present invention, a positive displacement rotary compressor includes a stator which contains a rotor and has a stator inlet communicating with atmosphere via a first pilot operated valve, a stator outlet connected to a primary lubricant reservoir via a non-return valve and to an auxiliary lubricant reservoir, which is always at substantially atmospheric pressure, via a second pilot operated valve, and a lubricant injection orifice connected to the primary reservoir via a third pilot operated valve and to the secondary reservoir, the compressor further including a pilot control system responsive, in use, to the compressed air load to which the compressor is subjected, and arranged to switch the first and third pilot operated valves from an open position to a closed position, and the second pilot operatd valve from a closed position to an open position when the compressed air load falls below a predetermined value.

The construction and operation of the compressor in accordance with the invention are thus similar to that disclosed in British Patent No. 1257728, the essential difference being that the auxiliary lubricant reservoir is situated on the downstream side of the pilot operated valve which selectively connects the stator outlet to atmosphere. This has the advantage that only the rotor/stator unit has to be depressurised when the compressor enters no-load conditions, and the auxiliary reservoir does not have to be depressurised which results in the depressurisation and the subsequent repressurisation occuring more rapidly and more economically. More significantly, in the compressor in accordance with the present invention, neither the primary reservoir nor the auxiliary reservoir are ever depressurised, and thus the problems arising from the foaming of the lubricant do not occur. This permits the rate of depressurisation to be very much higher than in the construction disclosed in British Patent No. 1257728 and indeed this depressurisation may take one second or less, and its duration is determined only by physical constraints which enables the full advantage achievable by complete depressurisation of the rotor/stator unit to be realised.

When the compressor enters a no-load or reduced load condition, the pressure at its inlet may fall and that at its outlet will tend to rise, and either of these pressure changes may be used to indicate the presence of such a condition. In one construction in accordance with the present invention, the first pilot operated valve has only two positions, that is to say a fully open position and a fully closed position. In this event, the control system preferably includes a pressure sensor responsive to a rise in the pressure in the primary reservoir, and the sensor may be situated either in the primary reservoir or in the compressor outlet line. In such a construction, when the compressed air load begins to drop, the pressure in the primary reservoir will rise, and when this reaches a predetermined value the pilot control system will reverse the positions of all the pilot operated valves, thus placing the compressor in an idling or no-load operating mode. The primary reservoir is then sealed from the stator and the reduced pressure at the lubricant injection orifice will result in lubricant being withdrawn from the secondary reservoir into the stator, which lubricant is subsequently returned to the secondary reservoir. The pressure in the primary reservoir will gradually drop and when it reaches a further predetermined value, the pilot control system will return the compressor to its normal operating mode. Thus, if the compressor is subjected to 50% of its full rated load, the compressor will operate in its normal mode for half the time, and in its idling mode for the remainder of the time.

If the compressor is subjected to, say, 90% of its full rated load, the construction referred to above may tend to cycle rapidly between the operating and idling modes which is of itself somewhat wasteful of power. Thus, in a further construction in accordance with the present invention, the first pilot operated valve is progressively movable between its open and closed positions to throttle the inflowing air, e.g. under the action of a pressure controlled by a servo valve responsive to the pressure in the primary reservoir, the pilot control system including a pressure sensor responsive to a fall in the pressure in the stator inlet. The provision of a servo controlled valve in the inlet, which corresponds to the conventional unloader valve, in this construction, will reduce the tendency of the compressor to cycle between its operating and idling modes since as the compressed air load gradually reduces, the servo controlled valve will be progressively closed, thereby restricting the volume of air that is compressed and counteracting the tendency of the pressure in the primary reservoir to rise. It is for this reason that the pressure sensor of the pilot control system of this construction is positioned to be responsive to a drop in the pressure at the inlet rather than a rise in the pressure at the outlet. However, the sensor at the inlet will not indicate the resumption of the compressed air load, as indicated by a fall in the pressure in the primary reservoir, since in the idling mode the inlet is isolated from the primary reservoir and this construction therefore preferably includes a further sensor responsive to the pressure in the primary reservoir and arranged to return the compressor to its normal operating mode when the pressure in the primary reservoir falls below a further predetermined value.

The auxiliary reservoir may be positioned at any appropriate position, but it is preferred that it communicates with the stator inlet. This will mean that if for some reason there is an excess of lubricant in the auxiliary reservoir, this excess will pass into the inlet and be returned, in general, to the primary reservoir. In the preferred construction the stator inlet communicates with an inlet housing which accommodates the first and second pilot control valves, and constitutes the secondary reservoir.

If the compressor cycles rapidly between its operating and idling modes, the lubricant in the line between the stator and the primary reservoir will tend to be returned to the secondary reservoir each time the compressor is switched from its operating to its idling mode. This might result in an accumulation of excess lubricant in the secondary reservoir, and to avoid this, the third pilot operated valve may include delay means to delay the return of that valve to its open position for a predetermined period e.g. a few seconds, after the compressor has returned to its operating mode which results in an additional amount of lubricant being withdrawn from the secondary reservoir to compensate for the additional amount of lubricant passed to it on the initiation of the idling mode.

Further features and details of the present invention will be apparent from the following description of three specific embodiments which is given by way of example only, with reference to the accompanying drawings, in which.

Figure 1:
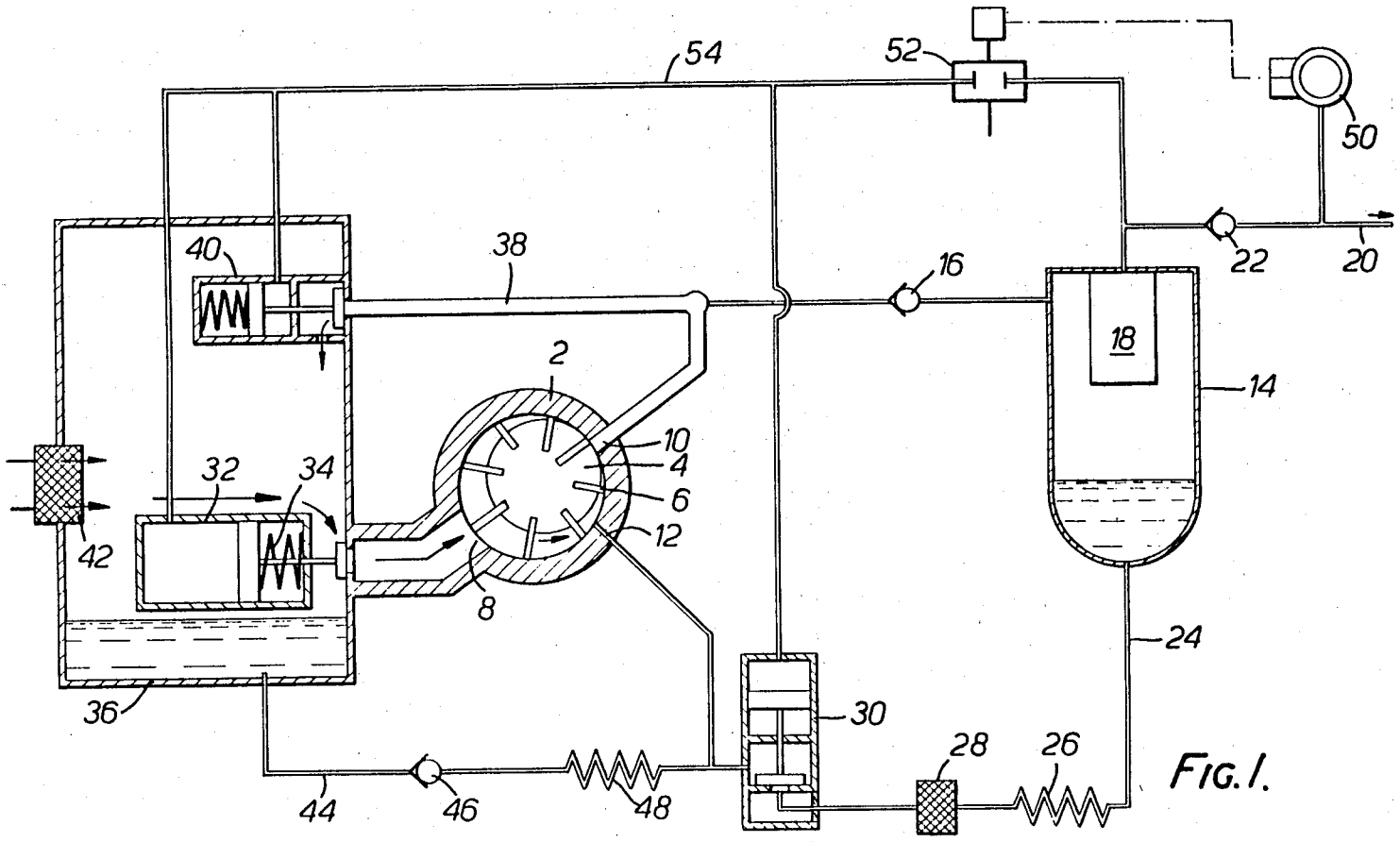
FIG. 1 is a diagrammatic representation of a rotary compressor in accordance with the present invention.

FIG. 1 diagrammatically illustrates a compressor of eccentric rotor sliding vane type which includes a stator 2 within which a rotor 4 is eccentrically rotatably mounted. The stator and rotor together define a crescent shaped working space which is divided into working cells by a number, in this case eight, of vanes 6 which are slidably accommodated in a respective longitudinal slot in the rotor. The construction and operation of this rotor/stator unit are conventional and will therefore not be described in more detail. The stator has an inlet 8, an outlet 10 and one or more oil injection orifices 12 situated between the inlet and the outlet with respect to the intended direction of rotation of the rotor. The stator outlet 10 communicates with a primary oil reservoir 14 via a non return valve 16, the reservoir 14 accommodating a conventional coalescing element 18 and communicating with a supply line 20 via a further non-return valve 22. The lower end of the primary reservoir 14 communicates with the oil injection orifices 12 via a line 24 which includes an oil cooler 26 and an oil filter 28, which are conventional and will therefore not be described, and a pilot operated shut-off valve 30. The stator inlet 8 is controlled by a pilot operated shut-off valve 32 which is biased into the open position by a return spring 34 and is accommodated within an inlet housing 36. The stator outlet 10 also communicates with the inlet housing 36 by means of a line 38 which is controlled by a further pilot shut-off valve 40. The inlet housing 36 communicates with the atmosphere via a conventional air filter 42, and constitutes a secondary or auxiliary oil reservoir the base of which communicates with the oil injection orifices 12 via a line 44 which includes a non-return valve 46 and a further oil cooler 48.

The compressor also includes a pilot control system comprising a pressure sensitive switch 50 which communicates with the supply line 20 and is thus responsive to the pressure within the primary reservoir 14 and which is connected to a solenoid operated shut-off valve 52 situated in a line 54 which extends between the primary reservoir 14 and the pilot control port of each of the three pilot controlled valves 30, 32, and 40.

In normal operation, the pilot control valves 30 and 32 are open whilst the pilot control valve 40 and solenoid operated valve 52 are closed. The rotor rotates within the stator and draws air in through the air filter 42 which passes around the open valve 32 and is compressed in the crescent shaped working space within the stator. Oil within the primary reservoir 14, which is at the supply pressure of the compressor, flows along the line 24 and through the open valve 30 into the working space via the injection orifices 12, and passes with the compressed air through the stator outlet 10. The compressed air and oil mixture all passes through the non-return valve 16 into the primary reservoir 14 since the valve 40 is closed, and the majority of the oil is instantly deposited in the primary reservoir 14 whilst the remainder is coalesced by the element 18. If the compressed air load should drop to zero, the pressure in the supply line 20 and thus the primary reservoir 14 will rapidly rise, to a value above the normal working value and when this pressure exceeds a predetermined value the pressure switch switches the solenoid valve 52 into the open position. This immediately transmits the high pressure in the reservoir 14 to the pilot control valves 30, 32 and 40, thereby closing the two former valves and opening the latter. Closure of the valve 30 prevents further oil from being withdrawn from the primary reservoir 14 and closure of the valve 32 prevents further air from being drawn into the stator and compressed. The opening of the valve 40 vents the interior of the stator to the atmosphere and the pressure at the stator outlet therefore drops to atmospheric within a very short space of time. The interior of the stator is thus isolated from the remainder of the compressor by the valve 32 which seals its inlet, the valve 30 which seals the oil communication with the primary reservoir and the non-return valve 16 which ensures that the primary reservoir is not vented down to atmospheric pressure as well. The residual air and oil within the stator passes through the line 38 and the valve 40 into the inlet housing 36 which constitutes the secondary reservoir and the entrained oil droplets are there deposited. By virtue of the slightly sub-atmospheric pressure at the oil injection orifices 12, a small amount of oil is constantly withdrawn from the housing 36 and injected through the orifices 12 which then passes along the line 38 and through the valve 40, and is thus constantly recycled.

When the compressed air load subsequently reappears, the pressure in the supply line 20 and primary reservoir 14 will rapidly drop and when it has reached a further predetermined value, the pressure switch closes the solenoid valve 52 which permits the valve 32 to return to its open position under the action of its return spring, and the compressor then resumes normal operation with the valve 30 opening and the valve 40 closing. If the compressed air load did not in fact drop to zero, but was merely some fraction of the full rated load, the compressor will cycle between the operating and idling modes for relative times determined by the actual compressed air requirement. It is found that the compressor in accordance with the present invention consumes only between about 10 and 20% of its full rated power when it is operating in the idling mode, and further that the stator can be fully depressurised and thus operating in its idling mode within about 1 second of the predetermined excess pressure being measured by the pressure sensor 50.

Figure 2:
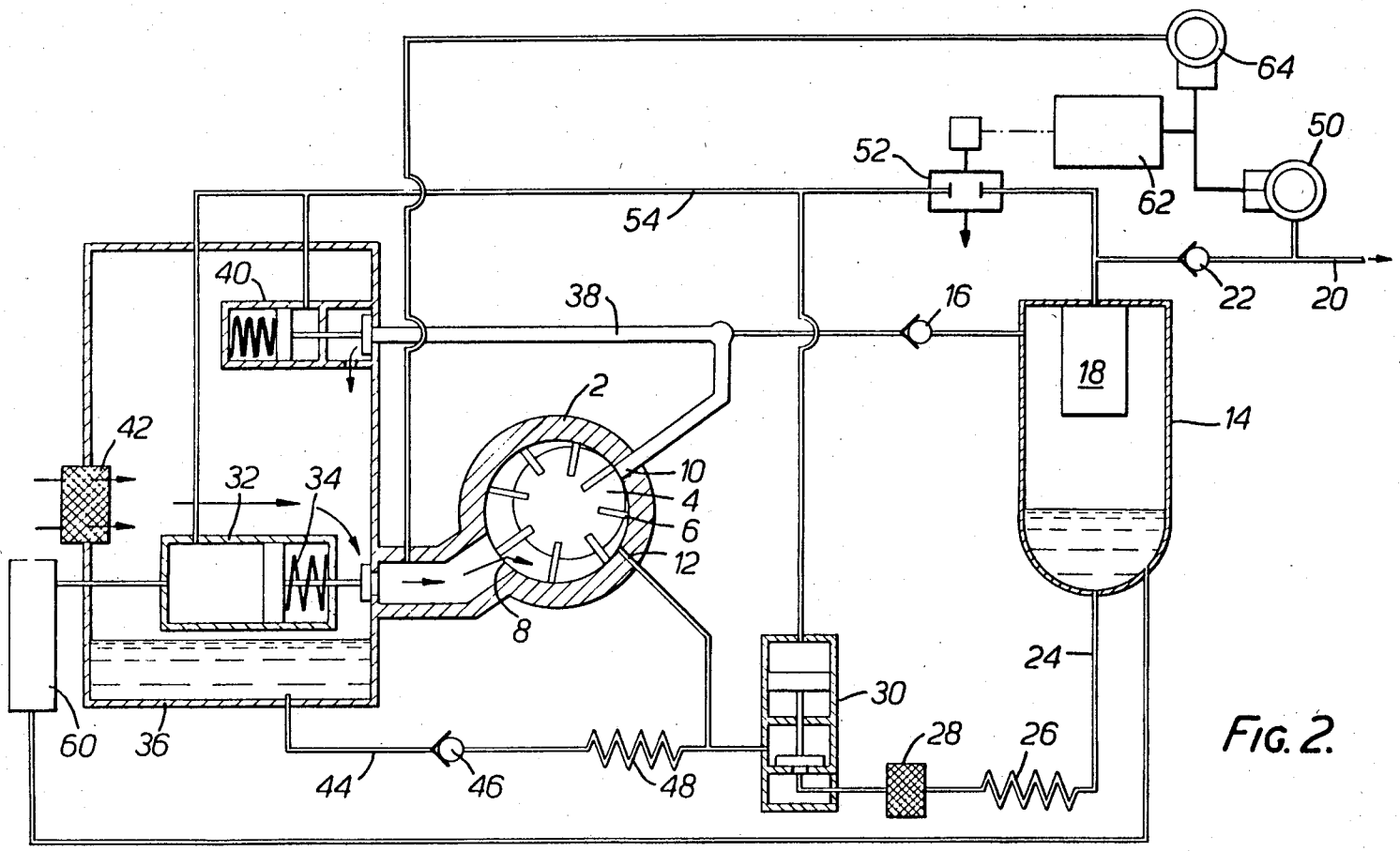
FIG. 2 is a similar representation of a modified construction of compressor.

The modified construction illustrated in FIG. 2 is very similar to that of FIG. 1 and the same reference numerals are used to designate similar components. However, instead of having only two positions, namely a fully open position and a fully closed position, the valve 32 constitutes an unloader valve which moves progressively to throttle stator inlet 8 under the action of a servo valve 60 which is subjected to the pressure prevailing within the primary reservoir 14. The construction and operation of this servo valve is conventional and disclosed in, for instance, British Patent Specification No. 1599319 , and corresponding U.S. Pat. No. 4,388,046, and will therefore not be described. In this construction, if the compressed air requirement should drop to, say, 80% of the full load, this is compensated for by a throttling of the stator inlet by the valve 32 to admit only 80% of the normal air throughput. Progressive throttling of the inlet leads to a reduction in the inlet pressure, but to a rather smaller increase in the outlet pressure than in the construction of FIG. 1, and for this reason the solenoid operated valve 52 is connected to a logic unit 62 which in turn is connected to a vacuum switch 64 which is subject to the pressure at the stator inlet 8. Thus, when the inlet pressure drops to a predetermined value, which may be at, say, a compressed air load which is 50% of the full rated load, the logic unit switches the solenoid operated valve which in turn switches all the pilot control valves and the compressor then operates in its idling mode. The reduced or subsequently resumed compressed air load will result in a decrease in the pressure prevailing in the primary reservoir, but it will be appreciated that this will not be reflected by an increase in pressure at the stator inlet since when in the idling mode the stator is isolated from the primary reservoir. For this reason the pressure switch 50 is provided in this embodiment also but its function is merely to return the compressor to normal operation when the pressure in the primary reservoir 14 sinks to a predetermined value. In other respects, the operation of this construction is the same as that of FIG. 1. Thus it will be appreciated that the addition of the servo valve and second pressure sensor ensures that the compressor does not cycle rapidly between its idling and operational modes when the compressed air load is a major proportion of the full rated load as may be the case in the construction of FIG. 1.

The construction illustrated in FIG. 3 is again very similar to that illustrated in FIG. 1 and the same reference numerals are used. In this construction the valve 32 again only has two positions, as in FIG. 1. In the constructions of FIGS. 1 and 2 the pilot operated valves are operated by the pressure of the air in the primary reservoir 14 but it will be appreciated that if the compressor operates in the idling mode for a long period of time the pressure in this reservoir may sink due to natural leakage to a value below which it cannot operate the valves. This risk is eliminated in FIG. 3 by operating the valves by the pressure of the compressed air at a point downstream of the non-return valve 22.

In FIGS. 1 and 2 all the pilot operated valves are operated simultaneously by the valve 52. However, in FIG. 3 the valves 30,32 and 40 are controlled by separate solenoid operated valves 70,72 and 74 respectively which in turn are controlled by a micro-processor logic unit 62 connected to the pressure switch 50. This permits the valve 30 to be returned to its normal position later, e.g. 5 seconds later, than the valves 32 and 40 after a period of idling operation thereby ensuring that for an initial period of normal operation oil is withdrawn from the secondary reservoir 36 rather than the main reservoir 14. This eliminates the potential risk that the secondary reservoir can become overfilled with oil due to the fact that each time the compressor is switched from its normal mode to its idling mode the oil between the injection orifices 12 and the non-return valve 16 would otherwise be returned to the secondary reservoir. The length of the delay is preferably so set that the amount of oil extracted from the secondary reservoir exactly compensates for that additional amount which is injected into it at the beginning of each idling phase.

In addition or alternatively, the valve 40 is arranged to be opened at the beginning of an idling phase slightly after the valve 30 has closed thereby ensuring that the majority of the oil within the stator at the beginning of the idling phase is returned to the primary reservoir rather than the secondary reservoir. This not only helps to alleviate the problem referred to above but also prevents the compressor inlet from "smoking" at the beginning of an idling phase due to a large volume of airborne oil suddenly being injected into the housing 36. To prevent oil simply being withdrawn from the secondary reservoir during this delay period the non-return valve 46 in the line 44 is replaced in FIG. 3 by a pilot-operated valve 76 which is controlled by the solenoid valve 74 to open and close at the same time as the pilot operated valve 40 so that oil cannot be withdrawn from the secondary reservoir until the valve 40 is open.

Figure 3:
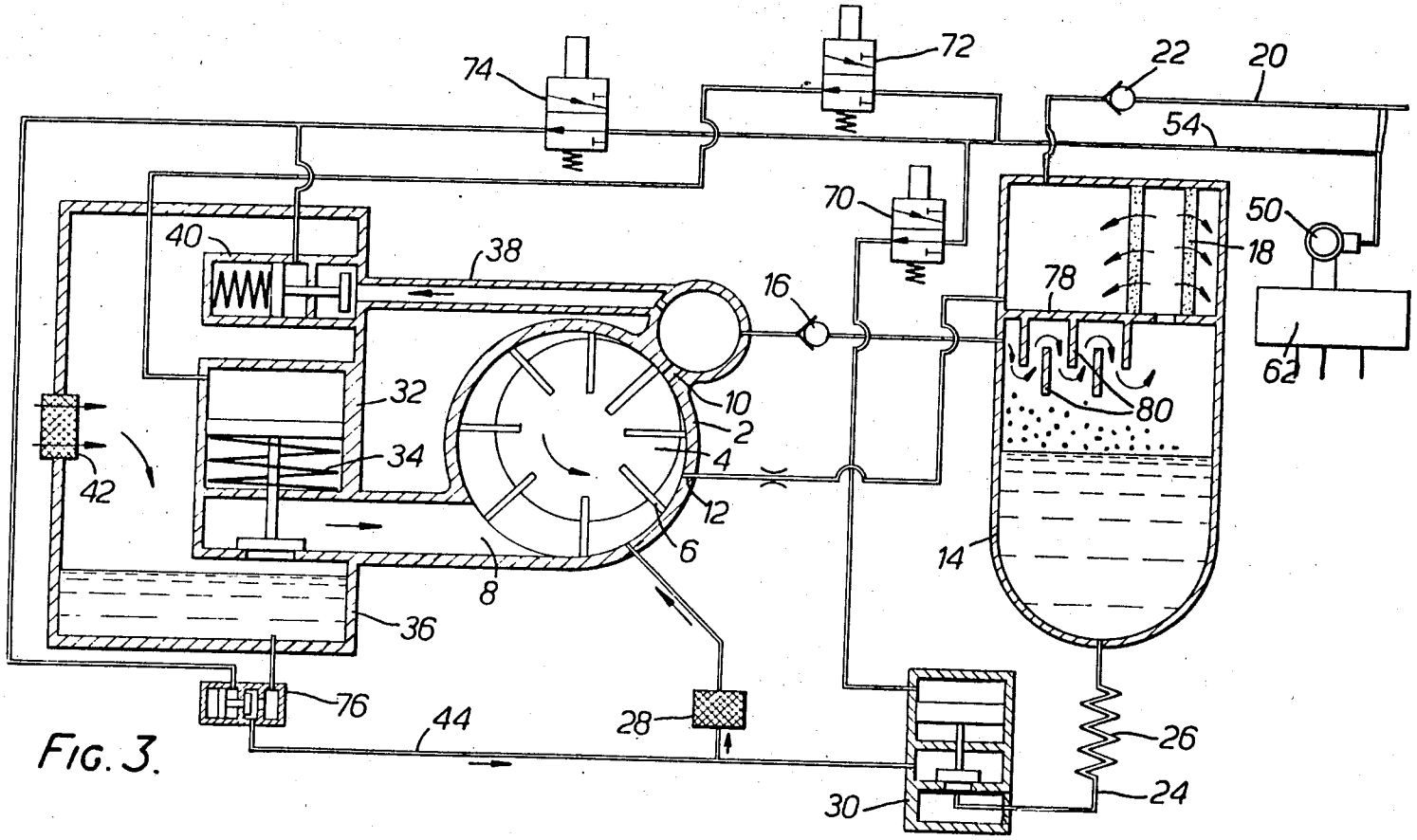
FIG. 3 is a similar representation of a further modified construction of compressor.

In other respects FIGS. 1 and 3 differ only in minor features. The oil filter 28 is situated downstream of the valve 30 and thus filters oil from both the primary and secondary reservoirs. The primary reservoir 14 is divided into two by a partition 78 and is provided upstream of the coalescing element 18 with a plurality of baffle plates 80 against which the compressed air impinges thereby depositing the majority of the entrained oil droplets. The oil separation is thus performed in two distinct stages, as is conventional.

It will be appreciated that any or all of the modified features of FIG. 3 may be incorporated also in the constructions of FIGS. 1 and 2. Whilst the specific constructions described above relate to compressors of eccentric rotor sliding vane type it will be appreciated that the present invention is applicable also to rotary compressors of other types, e.g. screw compressors.

Obviously, numerous modifications and variations of the present invention are possible in the light of the above teachings. It is therefore to be understood that within the scope of the appended claims, the invention may be practised otherwise than as specifically described herein.

What is claimed as new and desired to be secured by Letters Patent of the United States is:

1. A positive displacement rotary compressor including a stator, a rotor within said stator, a stator inlet, a first pilot operated valve, said stator inlet communicating with atmosphere via said first pilot operated valve, a stator outlet, a primary lubricant reservoir connected to said stator outlet, a non-return valve disposed between said stator outlet and said primary lubricant reservoir, an auxiliary lubricant reservoir which is always at substantially atmospheric pressure and which is connected to said stator outlet, a second pilot operated valve disposed between said stator outlet and said auxiliary lubricant reservoir, one or more lubricant injection orifices arranged to inject oil into said stator and connected to said primary reservoir and to said secondary reservoir, and a third pilot operated valve disposed between said one or more lubricant injection orifices and said primary reservoir, said compressor further including a pilot control system responsive, in use, to the compressed air load to which said compressor is subjected and arranged to switch said first and said third pilot operated valves from an open position to a closed position, and said second pilot operated valve from a closed position to an open position when said compressed air load falls below a predetermined value.

2. A compressor as claimed in claim 1 wherein said pilot control system includes a pressure sensor responsive to a rise in the pressure in said primary reservoir.

3. A compressor as claimed in claim 1 wherein said first pilot operated valve is progressively movable between said open and said closed positions to throttle the inflowing air, said pilot control system including a pressure sensor responsive to a fall in the pressure in said stator inlet.

4. A compressor as claimed in claim 1 wherein said secondary reservoir communicates with said stator inlet.

5. A compressor as claimed in claim 4 including an inlet housing communicating with said stator inlet with said inlet housing accommodating said first and second pilot controlled valves and constituting said secondary reservoir.

6. A compressor as claimed in claim 1 wherein said pilot control system is arranged to return said pilot operated valves to their original position when the compressed air load rises again above a predetermined value but to delay the return of said third pilot operated valve beyond that of said first and second pilot operated valves.

7. A compressor as claimed in claim 1 wherein said pilot control system is arranged to delay the opening of said second pilot operated valve beyond the closing of said third pilot operated valve.

8. A compressor as claimed in claim 1 including first, second and third servo valves respectively controlling said first, second and third pilot operated valves and a common logic unit controlling said servo valves.

9. A compressor as claimed in claim 8 including a line connecting said the or each lubricant injection orifice to said secondary reservoir, said line including a fourth pilot operated valve which is arranged to move in unison with said second pilot operated valve.

10. A compressor as claimed in claim 1 including a non-return valve downstream of said primary reservoir, all said pilot operated valves being actuated by the pressure downstream of the said non-return valve.

* * * * *